United States Patent [19]

Groth et al.

[11] 4,051,887

[45] Oct. 4, 1977

[54] PROCESS FOR PRODUCING SHEETS AND STRIP OF ZINC-COPPER-TITANIUM ALLOY

[75] Inventors: Volker Groth, Olfen; Adolf Stradmann, Datteln; Erich Pelzel, Puchheim, all of Germany

[73] Assignee: Rheinisches Zinkwalzwerk GmbH & Co. KG, Datteln, Germany

[21] Appl. No.: 664,728

[22] Filed: Mar. 8, 1976

[30] Foreign Application Priority Data

Mar. 13, 1975 Germany ..... 2510985

[51] Int. Cl.[2] ..... B22D 11/12

[52] U.S. Cl. ..... 164/76; 75/178 C

[58] Field of Search ..... 164/76, 87, 270, 287; 75/178 C; 29/527.7

[56] References Cited

U.S. PATENT DOCUMENTS 3,426,836 2/1969 Altenpohl et al. ..... 164/87 X

*Primary Examiner*—Robert D. Baldwin

*Attorney, Agent, or Firm*—Burgess, Dinklage & Sprung

[57] ABSTRACT

Deep-drawable sheets and strip are produced on a continuous casting machine with moving flexible belts and continuous finish-rolling without change of direction from a zinc-copper-titanium rolling alloy which is creep-resistant according to DIN 17 770 and foldable according to DIN 1 623. The alloy contains 1.5 to 5.5% copper, 0.05 to 0.25% titanium and, if desired, 0.005 to 0.05% aluminum, balance zinc. The zinc-copper-titanium alloy, wherein an increase in copper content is accompanied by a decrease in titanium content, is continuously cast into a slab having a thickness of 6–24 mm and a width from about 0 to 2000 mm, preferably 500–1500 mm. The slab is caused to solidify simultaneously and uniformly from both sides at a constant volumetric solidification rate and the slab is subjected to hot-rolling at temperatures above 100° C and at least 3, preferably 5 passes, each of which results in a reduction in cross-section not in excess of 80%.

5 Claims, 1 Drawing Figure

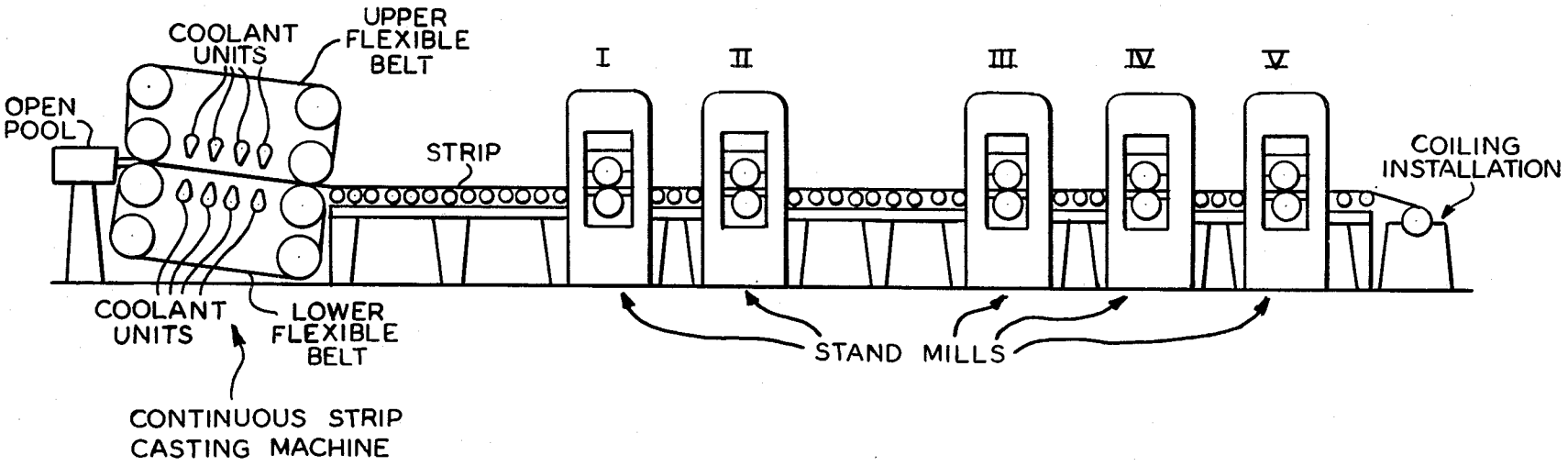
COILING INSTALLATION
V
IV
III
II
I
STAND MILLS
STRIP
UPPER FLEXIBLE BELT
COOLANT UNITS
OPEN POOL
LOWER FLEXIBLE BELT
COOLANT UNITS
CONTINUOUS STRIP CASTING MACHINE

PROCESS FOR PRODUCING SHEETS AND STRIP OF ZINC-COPPER-TITANIUM ALLOY

BACKGROUND

This invention relates to a process for producing deep-drawable sheets and strip from a zinc-copper-titanium alloy by means of continuous casting machine with moving flexible belts and with continuous finish-rolling without change of direction, from a zinc-copper-titanium rolling alloy which is creep-resistant according to DIN 17 770 and foldable according to DIN 1 623, consisting of 1.5 to 5.5% copper, 0.05 to 0.25% titanium and, if desired, 0.005 to 0.05% aluminum, balance zinc. Deep-drawing is used to make hollow pieces from sheets in such a manner that the shaped pieces can be reshaped on a commercial scale without incipient cracks and without substantial earing. There are two basic methods to render sheet metal deep-drawable as it is reshaped, namely by the deforming technology and by the alloying technology.

It is known from "Metall"16, 8, 1962, pp. 750/52, that the mechanical and technological properties of a titanium-containing zinc rolling alloy, inclusive of the deep-drawability, can be influenced by the copper content.

From Japanese Pat. Application 14 596/1968, there is known a process for the production of a deep-drawable zinc alloy which contains 0.3 to 3% of one or more of the metals copper, aluminum, nickel, beryllium, manganese, cadmium, as well as 0.03 to 0.16% of one or several of the metals titanium, magnesium, molybdenum, zirconium, tantalum, chromium, and which is treated at a temperature above 250° C, mostly 300° to 400° C, and then submitted to cold rolling, with a deformation of 20 to 60%. The deep-drawability of this alloy amounts to 1.90 to 1.198. There is also known a process (German OS 18 14 657) wherein a zinc alloy containing 0.05 to 2.0% copper and 0.005 to 0.4% titanium is hot-rolled at 230° to 270° C, with a reduction of 85 to 95% in at least one pass to reduce the earing during the drawing of the sheets produced from this alloy.

Attempts to also use these procedures known from the prior art for the production of deep-drawable zinc-copper-titanium rolling alloy which is creep-resistant according to DIN 17 770 and foldable according to DIN 1 623, being composed of 1.5 to 5.5% copper, 0.05 to 0.25% titanium and in some cases 0.005 to 0.05% aluminum, balance zinc, were not successful.

SUMMARY

The present invention provides a process by which the deep-drawability of the above-mentioned zinc rolling alloy can be increased to at least 1.8 to 2.0 and more and in which a continuous casting machine with moving flexible belts is used and with continuous finish-rolling without change of direction at temperatures within the range of primary recrystallization.

This is accomplished in that the zinc-copper-titanium rolling alloy described above wherein an increase in copper content is accompanied by a decrease in titanium content, is continuously cast to form a slab having a thickness of 6–24 mm, and a width from above zero to 2000 mm, preferably 500–1500 mm, the slab is caused to solidify simultaneously and uniformly from both sides and at a constant volumetric solidification rate, and the slab is subsequently hot-rolled at a temperature above 100° C in at least 3, preferably five passes, each of which results in a reduction in crosssection not in excess of 80%.

DESCRIPTION

The drawing is a schematic side elevation showing the overall casting and rolling apparatus of the present invention.

The process conditions of the invention result in a preferably globular structure which imparts to the material a deep-drawability of at least 1.8.

Suitably, the volumetric solidification rate amounts to about 6 to 200 $dm^3$ per unit of time.

In accordance with a preferred feature of the invention, the rolling alloy emerging as a continuous slab from the casting machine at a temperature of 120° to 400° C, preferably 300° to 380° C, is hot-rolled in five passes at a temperature of 100° to 350° C, preferably 200° to 300° C.

The invention is illustrated in more detail below by way of the following example.

A pearlitic zinc alloy containing 1.7% copper, 0.06% titanium and 0.01% aluminum, balance zinc, is cast at a temperature of 520° C in a continuous casting machine at a speed of 5000 mm per minute. The continuous slab emerging from the casting machine at a temperature of 360° C has a thickness of 18 mm and is rolled as follows:

| Stand | I/* | II | III | IV | V |
|---|---|---|---|---|---|
| Reduction (%) | 50 | 50 | 50 | 50 | 50 |
| Temperature (° C) | | | | | |
| before | 270 | | 220 | | |
| after | | 220 | | 160 | 110 |
| Characteristics | //* | | /* | | |
| Yield point | 140 | | 140 $N/mm^2$ | | |
| Ultimate tensile stress | 250 | | 300 $N/mm^2$ | | |
| Elongation at break | 80 | | 70 % | | |
| Hardness HVN | | 50 | | | |
| Creep strength | 70 | | 70 % | | |
| Folding test D=O | very good | | very good | | |
| Erichsen cupping test of 0.7 mm thick specimen limiting drawing ratio | | 14 | | | |
| (disk diameter)/(die diameter) | | 1,92 | | | |

*// = parallel to the rolling direction
*/ = at right angles to the rolling direction The materials which are described as "superplastic" are known for their ability to be well deformed by deep-drawing, mostly at elevated temperature. Even when a material in the form of a sheet has a good deep-drawing quality at room temperature, this is not necessarily accompanied by superplasticity at high temperature, unless it has a high elongation before necking occurs.

The alloy produced according to the process of the instant invention, having 1.5 to 5.5% copper, 0.25 to 0.05% titanium and, if desired 0.005 to 0.05% aluminum, balance zinc, surprisingly shows a large elongation before necking occurs, i.e., a high deep-drawability, not only at room temperature, but also at temperatures up to approximately 300° C and a continuously increasing deep-drawability and increasing creep strength. The alloy consists at least 80% of mixed crystals.

As shown in the drawing the molten zinc-copper-titanium alloy is introduced from the pool between the two moving flexible endless belts of the continuous casting machine. The belts move parallel to each other creating conveyor-like mold walls. The metal is rapidly cooled and solidified by water, which is circulated at high, uniform velocities on the opposite side of the belts by water jets. The freshly cast ingot is directly hot rolled after casting in a 2-stand two-high roughing mill and in a 3-stand two-high finishing mill. After rolling the strip is coiled at the coiling installation.

We claim:

1. Process for producing deep-drawable sheets and strip by means of a continuous casting machine with moving flexible belts and continuous finish-rolling without change of direction, which comprises providing a zinc-copper-titanium rolling alloy which is creep-resistant according to DIN 17 770 and foldable according to DIN 1 623, consisting of 1.5 to 5.5% copper, 0.05 to 0.25% titanium and balance zinc, wherein an increase in copper content is accompanied by a decrease in titanium content, continuously casting the zine-copper titanium alloy having a thickness of 6-24 mm and an effective width up to 2000 mm causing the slab to solidify simultaneously and uniformly from both sides at a constant volumetric solidification rate, and subsequently hot-rolling said slab at a temperature above 100° C in at least three, passes, each of which results in an effective reduction in cross-section not in excess of 80%.

2. Process of claim 1 wherein the constant volumetric solidification rate amounts to approximately 6 to 200 $dm^3$.

3. Process of claim 1 wherein the alloy slab emerging from the casting machine at a temperature of 120° to 400° C, is hot-rolled in five passes at a temperature of 100° to 350° C,

4. Process of claim 1 wherein said zinc-copper titanium rolling alloy also contains from 0.005 to 0.05% aluminum.

5. Process of claim 1 wherein said slab has a width from 500–1500 mm.

* * * * *

UNITED STATES PATENT AND TRADEMARK OFFICE

CERTIFICATE OF CORRECTION

PATENT NO. : 4,051,887

DATED : October 4, 1977

INVENTOR(S) : Volker Groth, et al.

It is certified that error appears in the above-identified patent and that said Letters Patent are hereby corrected as shown below:

Column 3, line 20, insert --into a slab-- after "alloy".

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*